United States Patent [19]

Gladwin, deceased

[11] 4,351,383

[45] Sep. 28, 1982

[54] BEARINGS FOR CONTINUOUS CASTING ROLLER APRONS

[75] Inventor: Floyd R. Gladwin, deceased, late of Grosse Ile, Mich., by Yvonne J. Gladwin, executrix

[73] Assignee: Gladwin Corporation, Taylor, Mich.

[21] Appl. No.: 138,850

[22] Filed: Apr. 10, 1980

[51] Int. Cl.[3] ..... B22D 11/12

[52] U.S. Cl. ..... 164/448; 164/442; 308/239

[58] Field of Search ..... 164/442, 448; 29/116 R; 308/DIG. 8, 238, 239

[56] References Cited

U.S. PATENT DOCUMENTS 2,691,814 10/1954 Tait ..... 308/238 X 4,137,963 2/1979 Langer et al. ..... 164/448

*Primary Examiner*—R. L. Spruill

*Assistant Examiner*—J. Reed Batten, Jr.

*Attorney, Agent, or Firm*—Cullen, Sloman, Cantor, Grauer, Scott & Rutherford

[57] ABSTRACT

Rollers used in roller aprons, which support and guide the metal strand formed in a continuous casting mold, are made of a fixed shaft and elongated roller sleeve sections which are rotatably mounted upon the shaft. The shafts are fastened upon spaced apart rails secured to support plates. Bearings are arranged between the ends of each sleeve section and its shaft. Each bearing comprises a journal type bearing part and a thrust type bearing part. The journal type bearing part includes a cylindrical bronze sleeve non-rotatably fitted within its roller section end. A "Teflon", bronze impregnated, thin wall liner bushing is fitted within a wide recess formed in the interior wall of the outer end of the bronze sleeve to thereby form about one-half of the journal bearing inner wall surface which is arranged in rotatable contact with its shaft. A bored support member, through which the shaft is extended and which connects the shaft to a rail, has a cylindrical part fitted into an endwise opening channel in the adjacent roller sleeve end. A transversely arranged, disk-like thrust bearing plate mounted on the inner transverse surface of the cylindrical part, engages with the co-planar, annular surfaces forming the outer ends of the bronze sleeve and its Teflon liner bushing to provide the thrust bearing part.

8 Claims, 7 Drawing Figures

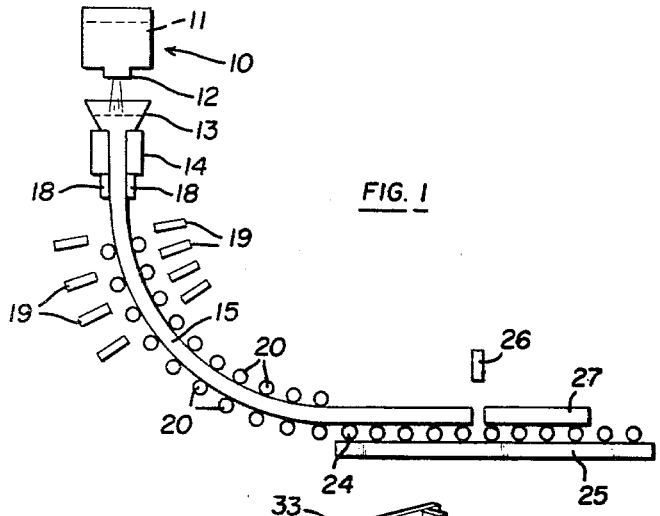
FIG. 1
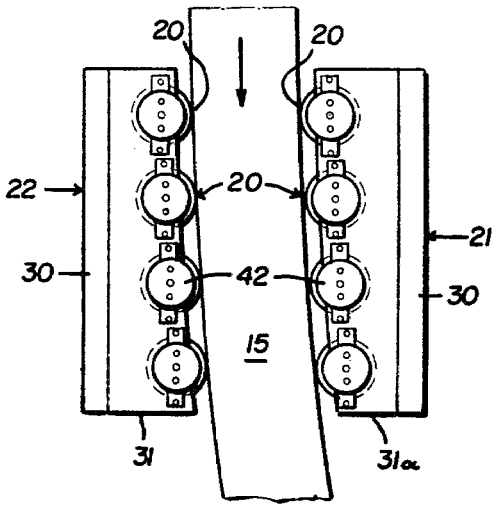
FIG. 2
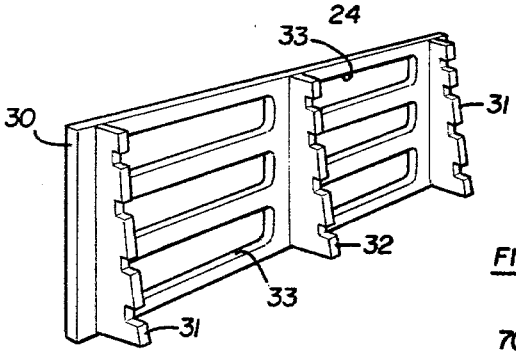
FIG. 3
FIG. 4
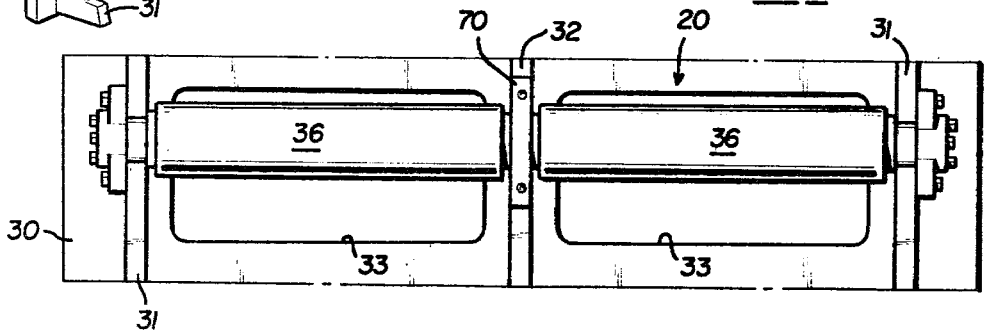
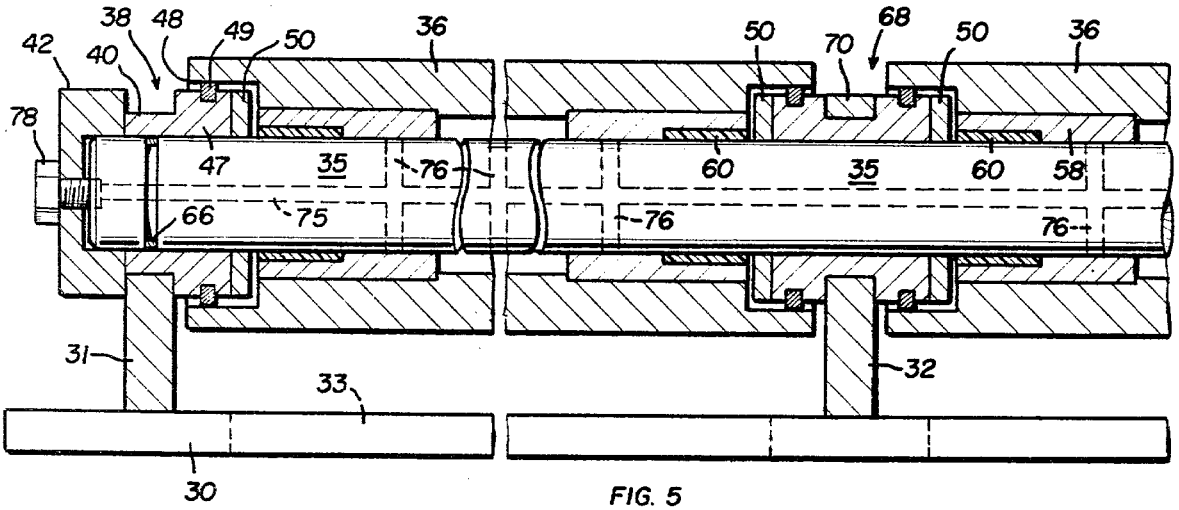
FIG. 5

BEARINGS FOR CONTINUOUS CASTING ROLLER APRONS

BACKGROUND OF INVENTION

The invention herein relates to a bearing construction for rollers used in supporting and guiding the metal strand formed in a continuous casting process. The process itself and the apparatus used therewith is generally described in the patent to Jackson, U.S. Pat. No. 4,023,612 issued May 17, 1977.

In general, the continuous casting process involves the gravity pouring of molten metal, such as steel, into the upper end of a box-like mold which has an open bottom. The mold is cooled, such as by water flowing through its walls.

As the metal cools, it forms a strand or slab having an outer, solidified skin that forms where the molten metal contacts the interior, cooled walls of the mold, and an inner molten core. This strand emerges downwardly through the open lower end of the mold. Then the strand is curved into a horizontal direction. The elongated strand is guided and supported between roller aprons which comprise a large number of support rollers. Meanwhile, water sprays are directed, between the rollers, upon the outer surface of the strand to continue the cooling process so that the strand ultimately becomes completely solidified.

As the slab or strand moves in the horizontal direction, supported upon rollers, it is cut into lengths. The cut slab lengths are then removed for further processing, such as for rolling into sheet steel or the like.

The strand or slab is typically rectangular in cross section, as for example four to nine inches in thickness and about three to five feet in width. The support and guide rollers engage the wide opposite faces of the strand. Because of the intense heat, substantial loads due to the weight of the metal and the tendency of the strand to bow outwardly under the internal ferrostatic pressure of the molten core, and the water and steam atmosphere surrounding them, the bearing constructions and supports for the rollers tend to wear out or fail relatively quickly. When this happens, this requires shut-downs of the operation, replacement of damaged or disabled parts and then start-ups which are time consuming and difficult because of the continuous nature of the casting operation.

The rollers are formed of an internal, non-rotatable shaft whose opposite ends are secured to end rails. Each shaft may be additionally secured between its ends to intermediate rails. Tubular roller sleeve sections are rotatably mounted upon each shaft. These roller sleeve sections engage the adjacent metal strand face. Thus, bearings are arranged between the rotatable sleeve sections and their shafts upon which they are mounted for rotation.

The invention herein relates to an improved bearing construction for the rollers, which construction substantially increases the life of the bearings, as compared to prior bearing constructions.

SUMMARY OF INVENTION

The invention herein contemplates an improved bearing construction for use between the fixed shaft and the surrounding rotatable roller sections carried by the shaft. The bearing construction is formed in two parts, namely, a journal type bearing part and a thrust type bearing part. The journal part comprises a bronze type bearing sleeve press-fitted within the roller sections, at each end thereof, for a non-slip, frictional engagement with the interior wall of the roller section. The inner wall of the bronze bearing sleeve is rotatably or slip-fitted upon the shaft.

A thin wall liner bushing of a low coefficient of friction material, such as a "Teflon"-bronze impregnated material, is inserted within the bronze sleeve. The liner fits within a recess in the interior of the bearing sleeve and occupies roughly half of the interior wall surface thereof. Thus, the inner wall surface of the thrust bearing is formed of roughly one-half low coefficient of friction "Teflon"-type material and the other half of bronze bearing material. The bronze bearing material, being of higher compressive strength, handles more of the compressive loads while the frictional drag and wear is reduced considerably by the Teflon liner.

In addition to the journal bearing, the thrust bearing part is arranged to handle the lateral or endwise shifting of the roller sections which occur in operation. Such thrust bearing is formed of a bored support ring-like member which is connected to a support rail and through which the shaft passes. One end of the member is telescopically fitted within an end channel or recess formed in the roller sleeve. A bronze disk thrust bearing member is arranged within the recess between the end of the member and the adjacent annular end surface of the bronze bearing sleeve and exposed "Teflon" liner. Hence, movement of the roller section towards the support member results in a bearing engagement between the disk, the bronze sleeve, the exposed end of the "Teflon" liner, and the adjacent interior wall of the recess formed in the roller section. This arrangement provides the necessary strength and slippage for rotation of the roller under the load of the metal strand.

The improved bearing construction herein appears to give a much longer life than conventional bearing arrangements and more particularly, permits the use of smaller diameter rollers than that permitted by prior conventional bearing arrangements. Consequently, it is possible to use more rollers on the roller apron, which is a considerable advantage in improving the equipment. That is, with smaller diameter rollers and with more rollers formed on the roller aprons, there is less space between the rollers and more lines of pressure to contain and guide the continuously formed slab, particularly in the areas where the skin is thin and the molten core pressure is still high enough to bow or bulge the slab skin outwardly.

The use of a low coefficient of friction material such as "Teflon" or the "Teflon"-bronze impregnated material would ordinarily not be considered feasible in the environment of roller apron constructions. That is, the loads, heat, and destructive atmosphere normally would be expected to rapidly destroy such material and prevent its use. However, with the construction as described in this application, the bearings are unexpectedly stronger and able to sustain the pressures and loads better than conventional journal bearings.

Further objects and advantages of this invention will become apparent upon reading the follow description, of which the attached drawings form a part.

DESCRIPTION OF DRAWINGS

FIG. 1 is a schematic view of the continuous casting process.

FIG. 2 is an enlarged, end view, schematically showing a pair of opposed roller apron sections with the continuous cast strand between them.

FIG. 3 is a perspective view of the apron plate or roller support plate.

FIG. 4 is an enlarged plan view of a two section roller mounted upon the support plate.

FIG. 5 is a cross sectional, elevational view, of one end and the middle of the roller illustrated in FIG. 4.

DETAILED DESCRIPTION

Figure 6:
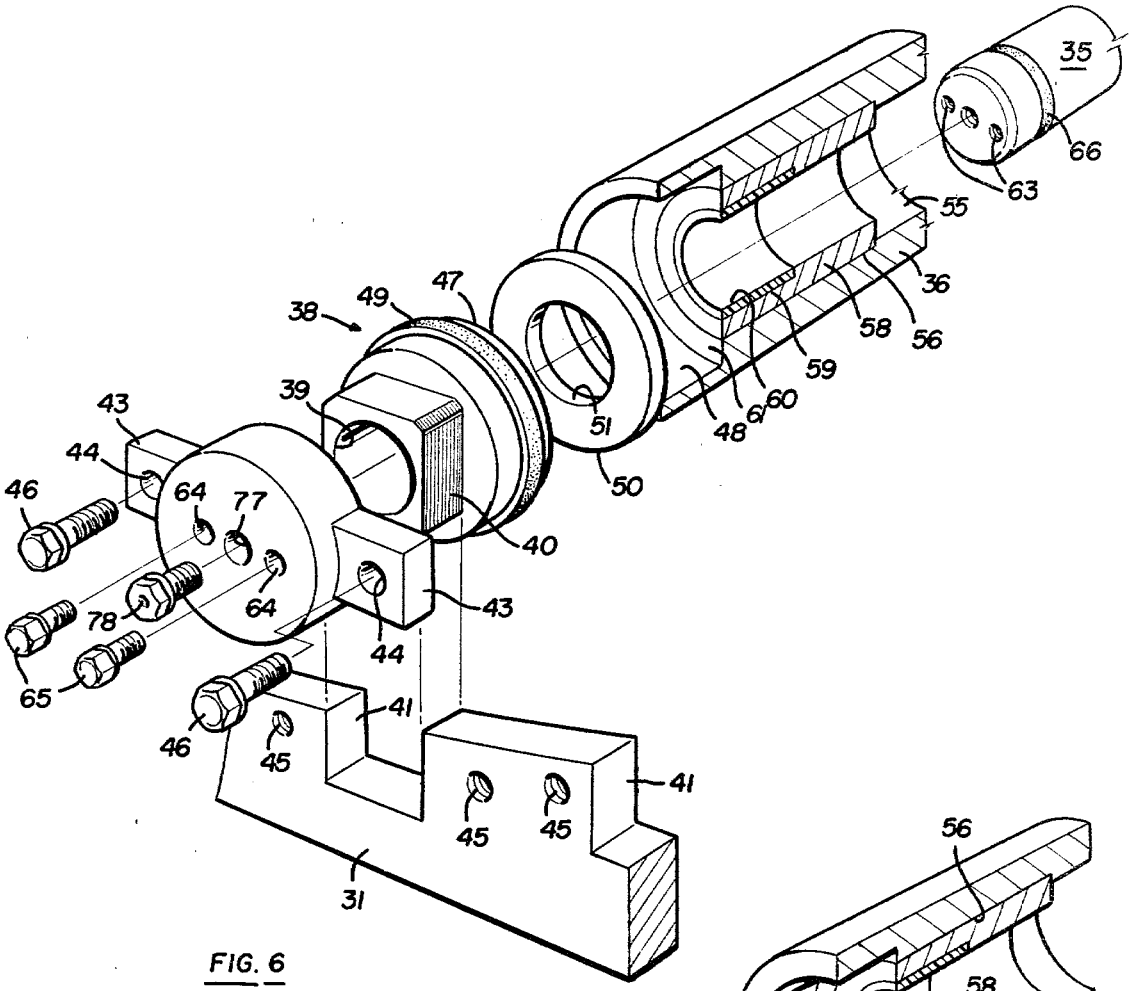
FIG. 6 is an enlarged, partly cross sectional, perspective view showing the disassembled parts which make up the end connection and bearing construction.

FIG. 1 schematically illustrates the continuous steel casting process. The equipment begins with a ladle 10 which carries molten steel 11 from the furnace to the continuous casting equipment. The molten steel gravity drops downwardly from the ladle either through a nozzle 12 or by tipping the ladle for pouring into a tundish 13. A reservoir of molten steel in the tundish provides the continuous flow of molten metal downwardly, by gravity, into the upper, open end of a water cooled continuous casting mold 14.

The water cooled mold is conventionally made of opposed side walls and end walls, connected together to form a box-like construction with open upper and lower ends. An example of this type of mold construction is shown and described in the patent to Floyd R. Gladwin, U.S. Pat. No. 3,964,727 issued June 22, 1976.

The particular mold used here is immaterial to the bearing construction which is the subject matter of this application. However, the mold typically forms a continuous strand or slab which is on the order of about four to nine inches in thickness and three to five feet in width, although the dimensions may vary considerably from that given above.

When the molten steel is poured into the upper end of the mold, the portions of the metal in contact with the water cooled mold interior walls begin to solidify rapidly and form a thin skin. Within the skin is the molten core.

Thus, as the slab or strand 15 gravity moves downwardly through the open lower end of the mold, it comprises a roughly rectangular shaped in cross section envelope of solidified skin within which is the molten core. The molten metal within the slab exerts a substantial outward ferrostatic pressure which tends to bulge the skin outwardly.

The strand passes through cooling plates 18 or cooling rollers or pull rollers, as the case may be depending upon the kind of equipment used. From that point downwardly, water spray nozzles 19 are directed upon the strand to chill it and continue the cooling of the core. Meanwhile, roller apron guide rollers 20 guide the strand downwardly and then along a curve until the strand is arranged horizontally. These guide rollers also hold the strand against bulging because of the interior ferrostatic pressure.

The roller aprons are formed in sections or units, as illustrated for example in FIG. 2. These units are arranged to form curved upper units 21 and lower units 22 between which the strand 15 is guided.

When the strand turns into the horizontal direction, it is carried upon support rollers 24 which are made in the same way as the guide rollers 20. However, the support rollers 24 are carried upon suitable support bases or base construction sections 25. The support rollers move the strand beneath a conventional cutter 26 which cuts off pre-determined slab lengths 27. These slab lengths are then moved into storage or transportation areas for later use in steel fabrication processes, such as for use in a rolling mill to make sheet material or the like.

The roller apron sections, each have an apron plate 30 (see FIGS. 2 and 3) which is provided with parallel end rails 31 and **31*a* and one or more center rails 32 upon which the rollers are mounted. The plates are also provided with suitable large openings 33** through which the water spray may be directed, between the rollers, against the metal strand.

The rollers 20 are each formed of a central steel shaft or axle 35 upon which are rotatably positioned roller sleeve sections 36. The shaft 35 is fixed against rotation and preferably is chrome plated by any suitable conventional technique. The opposite ends of the shafts are secured to rails 31 by means of end support members 38. A bored opening 39 in such member receives the end portion of a shaft.

The support member is secured to the rail first by means of a squared section 40 which snugly fits within one of the notches 41 formed in each of the rails. In addition, an end cap 42, which is cup shaped to fit over and receive the end of the shaft, is provided with fastening ears 43 which are secured to the adjacent rail portion. Holes 44 formed in each of the ears are aligned with corresponding holes 45 in the rail so as to receive fastening screws 46 (see FIG. 6).

Each end support member 38 includes a cylindrical end portion 47 which fits into an annular recess or groove 48 formed in the opposite ends of the roller sleeves 36. One or more conventional automotive engine type piston rings 49, positioned within grooves formed in the end member cylindrical portion, seals against the inner surface of the sleeve recess.

A bronze type thrust bearing disk 50 is arranged within the sleeve recess 48 adjacent the transverse end of the support member cylindrical portion 47. An opening 51 through the disk receives the shaft 35.

The diameter of the interior surface 55 in the roller sections are larger than the shafts upon which the roller sections are positioned. Moreover, enlarged bearing recesses 56 are formed at the opposite ends of the roller sleeve openings.

Bronze journal type bearing sleeves 58 are press-fitted within the bearing recesses 56 for non-rotatable, frictional mounting therein. Each bearing sleeve 58 is also provided with an end recess 59 which receives a tubular shaped "Teflon" liner 60. The liner is roughly one-half of the length of the sleeve 58 so that its inner wall surface forms about one-half of the bearing or slip-fit surface of the journal bearing for rotatably enveloping the fixed shaft 35.

By way of example, the "Teflon" liner may be on the order of about 0.125 thick and may be bronze impregnated Teflon tubing. This material is commercially available, although it has not previously been thought of as a suitable bearing material for this environment because of its relative low strength, etc.

The free, annular ends of the "Teflon" liner, surrounding bronze bearing sleeve 58, and an annular end wall 61 formed within the roller sleeve recess 48 provide a coplanar surface for engaging the bronze thrust bearing disk 50. Normally, the disk 50 is spaced a short distance from that surface. Engagement takes place when the roller sleeve section moves in the direction of the disk which occurs from time to time during operation, but ordinarily not continuously. FIG. 5 illustrates the normal spacing between the disk 50 and the annular surface within the roller sleeve recess 48.

The end of the shaft 35 is fixedly connected to the end cap 42 by means of threaded openings 63 formed in the shaft (see FIG. 6) which are aligned with openings 64 formed in the end cap to receive fastening screws 65. Further, an O-ring 66 arranged within a groove formed in the shaft 35, seals the shaft to the interior of the end cap. An automotive type piston ring of the appropriate size may be used for such an O-ring seal.

Figure 7:
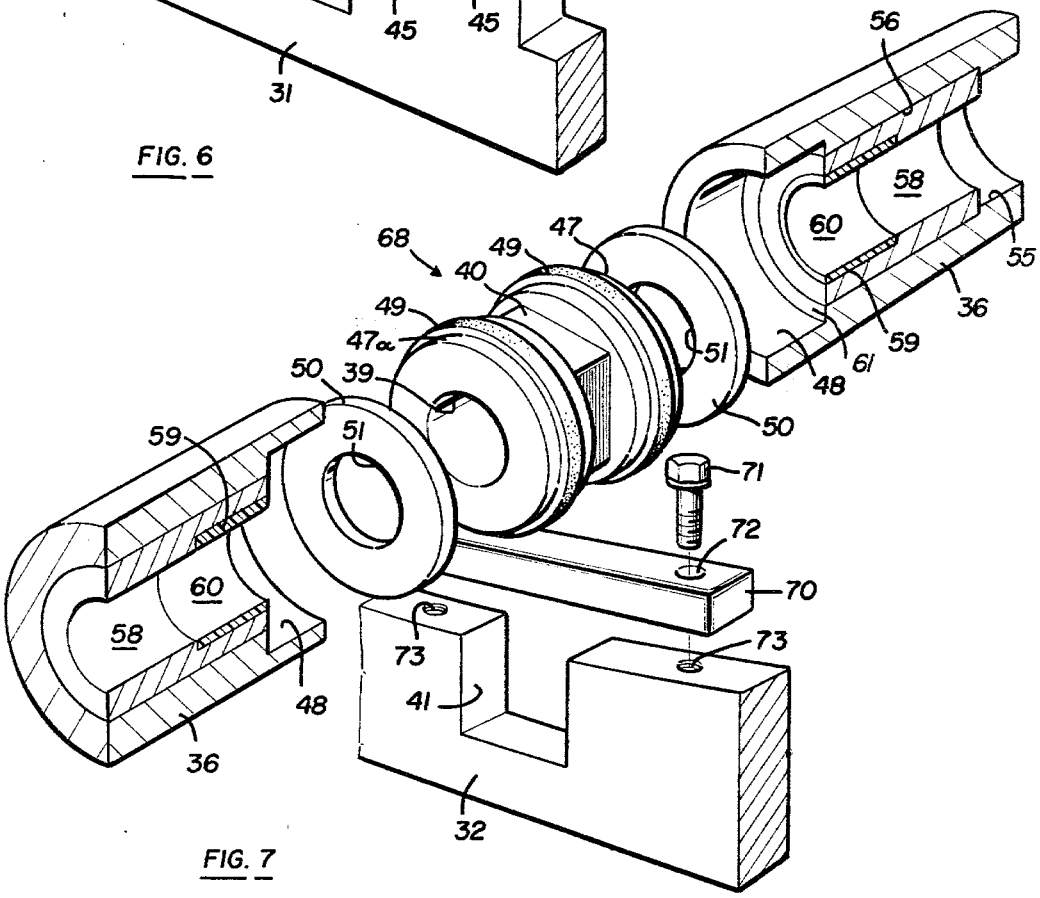
FIG. 7 is an enlarged, partly cross sectioned, perspective view showing the disassembled parts which make up the middle bearing construction of a roller.

It can be seen that the chrome plated shaft 35 is non-rotatably secured to the rails so as to span a pair of spaced apart end rails. Meanwhile, a number of sleeve sections 36, rotatably supported upon the shaft, may independently rotate thereon. The number of roller sleeve sections may be varied and typically would be on the order of 2, 3 or 4 sections, depending upon the span required. Each of the roller sleeve sections is provided with the interior journal bearing construction described above as well as the thrust bearing construction. To form the thrust bearing construction between the ends of the shaft, that is at the middle rails 32, the end support member is slightly modified to form a middle support member 68, as shown in FIG. 7. Such middle support member includes the squared section 40 and the cylindrical portion 47, but includes a second cylindrical portion 47*a* which also has one or more piston ring types of seals 49, as described above. Otherwise, the middle support member 68 is the same in construction as that of the end support member 38.

The squared portion 40 of the middle support member 68 snugly fits into one of the notches 41 formed in the center rail 32. It is locked in the notch by means of a lock bar 70 which rests upon the upper surface of the rail and the upper flat surface of the squared portion 40. The lock bar is secured to the rail by means of screws 71 extending through aligned holes 72 and 73 in the lock bar and the rail, respectively. The lock bar may be in the form of short lengths or of one long length to match the length of the central rail.

Where the rollers are formed of more than two roller sleeve sections, additional middle rails 32 are mounted upon the apron plate 30. The rails 32, as well as the end rails 31, may be suitably welded to the plate or otherwise permanently affixed thereto.

The space between the interior of the tubular roller sleeves and the shaft upon which the sleeves are mounted, is packed with a suitable high temperature lubricant or grease. This lubricant is applied through an axially extending hole 75 formed in each shaft. Transverse holes 76 carry the lubricant from the hole 75 into the spaces between the adjacent inner wall surfaces of the roller sleeve sections and the outer surface of the shaft, as well as in the small spaces between the journal bearings and the shaft. The lubricant is applied, when necessary, through a central opening 77 formed in the end cap, which is aligned with the opening 75 in the shaft. The end cap opening is normally closed by a screw type closure 78 (see FIGS. 5 and 6).

Although the dimensions may vary considerably, by way of illustration for the purposes of determining relationships of parts, a roller made in accordance with the construction described herein may comprise a shaft of about five feet in length with an O.D. of about $3\frac{1}{2}$ inches. The roller sleeve may have an O.D. of about $7\frac{1}{4}$ inches and if three sections are used, each would be slightly less than 16 inches in length with a wall thickness of about $\frac{3}{4}$ inch. The bronze journal bearings may be on the order of about two inches in axial length and about $\frac{1}{4}$ to $\frac{3}{8}$ inches in wall thickness. The liner of "Teflon" material may be on the order of about one inch in axial length and about 1/10 inch, e.g., 0.125, in wall thickness and may be made of a split ring configuration, that is, a length of sheet material which is rolled into a circular cross-sectional shape.

Conventional rollers are ordinarily of a considerably greater diameter. Thus, the bearing construction herein permits the reduction in O.D. of the rollers, thereby permitting more rollers to be used along the length of the continuously cast strand, with a space in between the rollers being much reduced as compared to the conventional aprons.

In operation, the apron sections are suitably supported upon a framework (not shown) which is conventional so as to form parallel, spaced apart, arrangements between which the strand passes (see FIG. 2). The rails of each apron are curved, either concave or convex, so as to mount the rollers 20 in a similar curved path. Thus, as the strand emerges downwardly from the mold 14, it begins curving due to the guiding of the rollers. The rollers are subjected to considerable forces or loads due to the weight of the metal as well as the tendency of the metal to bulge or bow outwardly because of the ferrostatic pressure of the molten core within the surrounding skin. However, as the skin thickens, along the downward curved path of the strand, the core pressure is contained within the skin itself. Nevertheless, the load upon the rollers and the adverse atmosphere within which it operates would normally tend to rapidly destroy the bearing constructions. However, the bearing construction herein, despite the much limited compression or load resistance of the "Teflon" bearing section as compared with the bronze section, provides a much greater life than an all bronze bearing, unexpectedly. Thus, the roller apron may be used for many more continuous casting production hours than the previously known constructions. Then, when the bearings ultimately begin to fail, the operation may be shut down and the roller sleeve sections, which normally are made of a suitable steel material, may be removed from the shafts and the bearings rebuilt relatively easily because of their simplified construction.

Having fully described an operative embodiment of this invention, I now claim:

1. In a roller apron for supporting and guiding a metal strand formed in a continuous casting mold through a cooling system such as a water spray or the like, said roller apron having spaced apart rails with elongated rollers extending between the rails and with the rollers each formed of a center shaft and with means fixedly mounting the shaft upon the rails, and a surrounding cylindrically shaped roller sleeve rotatably fitted around the shaft and having its inner circular wall spaced from the outer surface of the shaft, an improved bearing construction comprising:

a journal type bearing arranged between the shaft and roller sleeve and formed of an elongated, thin-wall, generally cylindrically shaped bearing sleeve surrounding the shaft and said bearing sleeve having an axial length, the entire outer surface along the axial length of said bearing sleeve being tightly in surface to surface contact with the inner wall of the roller sleeve so as to form a non-slip, frictional engagement with the roller sleeve and roughly one-half of the axial length of the inner surface of said bearing sleeve forming a rotatable contact with the shaft;

an annular, cylindrically shaped recess of substantial width formed along roughly one-half of the axial length of said bearing sleeve in the inner surface of the bearing sleeve and a thin-wall, cylindrically shaped liner bushing being tightly and non-rotatably fitted within and along substantially the full width of the recess, and the inner surface wall of the bushing rotatably engaging the shaft and forming a part of the shaft engaging wall surface of the bearing;

and said bearing sleeve being formed of a bronze-like bearing type material of relatively substantial compressive strength, and with the liner bushing being formed of a lower coefficient of friction, but lower compressive strength material;

said sleeve and said liner bushing together providing a reduced friction surface for said roller shaft than would be provided by a bronze-like sleeve, and yet providing greater resistance to compression forces transmitted by said shaft, in response to the temperature and ferrostatic pressures of said strand and said cooling system, than would be provided by a lower compressive strength material bushing.

2. A construction as defined in claim 1, and said recess being of a depth which is considerably less than one-half of the wall thickness of the bearing sleeve.

3. A construction as defined in claim 1, and said recess being open endwise at its end which is nearest to its adjacent roller sleeve end.

4. A construction as defined in claim 3, and the means for mounting at least one end of the shaft upon its adjacent rail comprising a sleeve-like support member telescopically receiving a portion of the shaft, and having means for mechanically and non-rotatably securing the member to the rail and the shaft;

said support member having an inner, cylindrically shaped end portion fitted within an annular groove formed within the adjacent roller sleeve end, so that said portion is surrounded by the roller sleeve, but fitted within its end;

a disk-like thrust bearing secured to the inner face of the member, which face is located within said end groove of the roller sleeve, with the thrust bearing normally spaced a short distance, measured axially, away from the adjacent bearing sleeve and bushing end surfaces, wherein upon axial shifting of the roller sleeve in a direction towards said support member, an endwise thrust-type slip engagement will take place between said bearing sleeve and bushing end surfaces and the disk-like thrust bearing.

5. A construction as defined in claim 4, and including a piston-type sealing ring arranged between and in contact with the stationary, outer surface of said support member portion and the rotating inner wall surface of the roller sleeve groove within which said portion is fitted for sealing therebetween.

6. A construction as defined in claim 4, and including a cup shaped end cap fitted over the end of the shaft and engaging the adjacent end of the supporting member, with said cap being mechanically fastened to the adjacent rail and to the shaft.

7. A construction as defined in claim 4, and including identical, but mirror image, bearing parts as set forth above, formed on the opposite ends of each shaft.

8. A construction as defined in claim 7, and each said roller sleeve being formed in at least two sections, with each inner end, which comprises adjacent ends, of each roller sleeve section including one of said journal type bearings and one of said disk-like thrust bearings.

* * * * *